US011549739B2

(12) United States Patent
Wang et al.

(10) Patent No.: US 11,549,739 B2
(45) Date of Patent: Jan. 10, 2023

(54) REFRIGERATING AND FREEZING DEVICE

(71) Applicant: HAIER SMART HOME CO., LTD., Shandong (CN)

(72) Inventors: Lei Wang, Qingdao (CN); Bo Jiang, Qingdao (CN); Chun Yang, Qingdao (CN); Xicai Lou, Qingdao (CN)

(73) Assignee: HAIER SMART HOME CO., LTD., Qingdao (CN)

( * ) Notice: Subject to any disclaimer, the term of this patent is extended or adjusted under 35 U.S.C. 154(b) by 312 days.

(21) Appl. No.: 16/959,019

(22) PCT Filed: Dec. 12, 2018

(86) PCT No.: PCT/CN2018/120692

§ 371 (c)(1),
(2) Date: Jun. 29, 2020

(87) PCT Pub. No.: WO2019/128717

PCT Pub. Date: Jul. 4, 2019

(65) Prior Publication Data

US 2020/0333062 A1 Oct. 22, 2020

(30) Foreign Application Priority Data

Dec. 29, 2017 (CN) ..... 201711489321.2

(51) Int. Cl.

| | |
|---|---|
| ***F25D 17/04*** | (2006.01) |
| ***F25D 11/02*** | (2006.01) |
| ***F25D 23/12*** | (2006.01) |
| ***F25D 25/02*** | (2006.01) |

(52) U.S. Cl.

CPC ..... *F25D 17/045* (2013.01); *F25D 11/02* (2013.01); *F25D 23/12* (2013.01); *F25D 25/025* (2013.01);

(Continued)

(58) Field of Classification Search

CPC ..... F25D 17/045; F25D 23/12; F25D 25/025; F25D 2317/04111; F25D 2317/04131

(Continued)

(56) References Cited

U.S. PATENT DOCUMENTS

2017/0261249 A1 9/2017 Chen et al.

FOREIGN PATENT DOCUMENTS

CN 102261800 A 11/2011
CN 104941325 A 9/2015

(Continued)

OTHER PUBLICATIONS

International Search Report of PCT/CN2018/120692 dated Mar. 4, 2019 (6 pages).

(Continued)

*Primary Examiner* — Steve S Tanenbaum
(74) *Attorney, Agent, or Firm* — Alston & Bird LLP

(57) ABSTRACT

A refrigerating and freezing device, the refrigerating and freezing device including: a casing, including an inner container, a housing, and a heat preservation layer, wherein a storage space is disposed in the inner container, a storage container is disposed in the storage space, and the storage container has a controlled atmosphere fresh-keeping space therein; and a controlled atmosphere membrane component, configured to allow more oxygen gas in an airflow in a space around the controlled atmosphere membrane component than nitrogen gas in the airflow in the space around the controlled atmosphere membrane component to pass through a controlled atmosphere membrane to enter an oxygen gas-enriched collecting cavity. The storage space is composed of a top cover and a bottom box, a lower surface of the top cover is provided with a concave cavity, and the controlled atmosphere membrane component is disposed in the concave cavity.

11 Claims, 7 Drawing Sheets

(52) U.S. Cl.
CPC ..... *F25D 2317/04111* (2013.01); *F25D 2317/04131* (2013.01)

(58) Field of Classification Search
USPC ..... 62/271
See application file for complete search history.

(56) References Cited

FOREIGN PATENT DOCUMENTS

| | | | | |
|---|---|---|---|---|
| CN | 205119638 | U | | 3/2016 |
| CN | 205784195 | U | | 12/2016 |
| CN | 106524645 | A | | 3/2017 |
| CN | 106679274 | A | | 5/2017 |
| CN | 106839586 | A | | 6/2017 |
| CN | 106839630 | A | | 6/2017 |
| CN | 107192197 | A | | 9/2017 |
| CN | 108302862 | A | | 7/2018 |
| JP | 2008082595 | A | | 4/2008 |
| KR | 20040083641 | A | * | 10/2004 |
| KR | 20040083641 | A | | 10/2004 |

OTHER PUBLICATIONS

Written Opinion for PCT/CN2018/120692 dated Mar. 4, 2019 (4 pages).
1st Search Report for CN Application No. 201711489321.2 (4 pages).
1st Office Action for CN Application No. 201711489821.2 (5 (pages).

* cited by examiner

REFRIGERATING AND FREEZING DEVICE

CROSS-REFERENCE TO RELATED APPLICATIONS

The present application is a national phase entry of International Application No. PCT/CN2018/120692, filed Dec. 12, 2018, which claims priority to Chinese Patent Application No. 201711489321.2, filed Dec. 29, 2017, which are incorporated herein by reference in their entirety.

FIELD OF THE INVENTION

The present invention relates to the technical field of refrigerator storage, and more particularly relates to a refrigerating and freezing device.

BACKGROUND OF THE INVENTION

A refrigerator is refrigeration equipment that maintains a constant low temperature, and is also a civilian product that keeps food or other articles in a constant low-temperature and cold state. With the improvement of the quality of life, consumers have higher and higher requirements on fresh keeping of stored food, especially on the color and luster, taste and the like of food. Therefore, the color and luster, taste, freshness and the like of the stored food should also be kept as unchanged as possible during the storage period. In order to better store food on the market at present, only vacuum fresh keeping is available. The vacuum fresh keeping methods often used are vacuum bag fresh keeping and vacuum storage compartment fresh keeping.

When the vacuum bag fresh keeping is used, consumers need to perform a vacuuming action every time they store food, which is inconvenient for operation and cannot get consumers' favor.

When the vacuum storage compartment fresh keeping is used, since the casing and the like are rigid structures, in order to maintain the vacuum state, the requirements on a vacuuming system are very high, and the requirements on the sealing performance of the refrigerator are very high. Every time an article is put in and out, too much fresh air flows in and the energy consumption gets higher. Moreover, in a vacuum environment, it is difficult for food to receive cold, which is especially unfavorable for food storage. In addition, due to the vacuum environment, it takes a lot of effort for a user to open a refrigerator door each time, which is inconvenient for the user to use. Although some refrigerators may ventilate the vacuum storage compartment through the vacuuming system, the user will wait for a long time, and the time efficiency is poor. A long vacuum time will also cause serious deformation of a refrigerator casing, that is, the existing refrigerator with a vacuuming structure may not complete the vacuum fresh keeping well. It requires a high strength of the casing, the implementation requirements are very high, and the cost is very high.

In addition, the inventors have found that the traditional nitrogen-making equipment used for controlled atmosphere fresh keeping is large in volume and high in cost, so the technology is basically limited to use in various large-scale professional storage rooms (the storage capacity is generally at least 30 tons). It may be said that which kind of appropriate controlled atmosphere technology and corresponding devices may be used to economically miniaturize and mute the controlled atmosphere system to make it suitable for home or personal users is a technical problem that those skilled in the field of controlled atmosphere fresh keeping have long been eager to solve but have not been able to solve successfully.

BRIEF DESCRIPTION OF THE INVENTION

The present invention is to overcome at least one defect in the existing refrigerators and provide a refrigerating and freezing device, which creatively proposes to discharge oxygen gas in air in a controlled atmosphere fresh-keeping space out of the space so as to obtain a nitrogen-rich oxygen-depleted gas atmosphere that is beneficial to food fresh keeping. The gas atmosphere reduces the aerobic respiration intensity of fruits and vegetables by reducing the oxygen gas content in the fruit and vegetable storage space, and at the same time, ensures the basic respiration and prevents the fruits and vegetables from anaerobic respiration, thereby achieving the objective of long-term fresh keeping of fruits and vegetables.

A further objective of the present invention is to ensure airtightness of a storage container.

A further objective of the present invention is to prevent condensation from being generated in the controlled atmosphere fresh-keeping space.

In order to achieve at least one of the foregoing objectives, the present invention provides a refrigerating and freezing device. The refrigerating and freezing device is characterized by including a casing and a controlled atmosphere membrane component, wherein a storage space is defined in the casing, a storage container is disposed in the storage space, and the storage container has a controlled atmosphere fresh-keeping space therein. The storage container includes a top cover and a bottom box; a lower surface of the top cover is provided with a concave cavity; and the bottom box is disposed below the top cover, and forms the controlled atmosphere fresh-keeping space together with the top cover. The controlled atmosphere membrane component is disposed inside the concave cavity, and includes at least one controlled atmosphere membrane and an oxygen gas-enriched collecting cavity. A space around the controlled atmosphere membrane component communicates with a controlled atmosphere fresh-keeping space. The controlled atmosphere membrane component is configured to allow more oxygen gas in an airflow in the space around the controlled atmosphere membrane component than nitrogen gas in the airflow in the space around the controlled atmosphere membrane component to pass through the controlled atmosphere membrane to enter the oxygen gas-enriched collecting cavity.

Optionally, the storage container further includes: a concave cavity bottom plate, detachably disposed at an opening of the concave cavity, and configured to partially close the concave cavity and support the controlled atmosphere membrane component.

Optionally, the concave cavity bottom plate is provided with a plurality of air holes such that the controlled atmosphere membrane component communicates with the controlled atmosphere fresh-keeping space.

Optionally, the top cover includes a concave cavity top plate forming a top surface of the concave cavity, and the concave cavity top plate is made of a stainless steel plate.

Optionally, an edge of the top cover is provided with a plurality of buckles, an edge of the bottom box facing the top cover is correspondingly provided with a plurality of protrusions, and each of the protrusions is inserted into the corresponding buckle to achieve snap fit assembling of the top cover and the bottom box.

Optionally, the storage container is a storage drawer, and a front side surface of the bottom box is provided with a drawer opening. The storage drawer further includes a drawing portion, capable of being pushed into an inside of the bottom box or drawn out of the inside of the bottom box to open or close the controlled atmosphere fresh-keeping space.

Optionally, the storage container further includes: a sealing strip, disposed between joint edges of the top cover and the bottom box to seal a gap between the top cover and the bottom box.

Optionally, the refrigerating and freezing device further includes: an air extracting device, wherein the air extracting device includes an air extracting pump, and is configured to extract gas penetrating into the oxygen gas-enriched collecting cavity to an outside of the storage container, and enable gas flowing out of the oxygen gas-enriched collecting cavity to firstly perform heat exchange with a pump casing of the air extracting pump and then enter the air extracting pump, or enable the gas flowing out of the oxygen gas-enriched collecting cavity to firstly enter the air extracting pump and flow out of the air extracting pump and then perform heat exchange with the pump casing of the air extracting pump.

Optionally, the air extracting device further includes a seal box to accommodate the air extracting pump; and an air extracting opening of the air extracting pump communicates to a vent port of the oxygen gas-enriched collecting cavity via an air extracting pipeline, and a vent port of the air extracting pump communicates with an inner space of the seal box; and a gas discharge pipeline communicating with the inner space of the seal box is disposed on the seal box.

Optionally, the casing is provided with an inner container, a housing disposed on an outer side of the inner container, and a heat preservation layer located between the inner container and the housing; a storage space is defined in the inner container; and the air extracting device is disposed in the heat preservation layer between the inner container and the housing.

Optionally, the controlled atmosphere membrane component further includes a support framework having a first surface and a second surface parallel to each other, a plurality of airflow passages respectively extending on the first surface, extending on the second surface, and penetrating through the support framework to communicate the first surface and the second surface are formed on the support framework, and the plurality of airflow passages together form the oxygen gas-enriched collecting cavity; and the at least one controlled atmosphere membrane is two planar controlled atmosphere membranes respectively laid on the first surface and the second surface of the support framework.

Since the refrigerating and freezing device of the present invention includes the controlled atmosphere membrane component and the air extracting pump, the nitrogen-rich oxygen-depleted gas atmosphere that is beneficial to food fresh keeping can be formed in the controlled atmosphere fresh-keeping space. The gas atmosphere reduces the aerobic respiration intensity of fruits and vegetables by reducing the oxygen gas content in the fruit and vegetable storage space, and at the same time, ensures the basic respiration and prevents the fruits and vegetables from anaerobic respiration, thereby achieving the objective of long-term fresh keeping of the fruits and vegetables.

Further, the storage container forming the controlled atmosphere fresh-keeping space is composed of the top cover and the bottom box, the lower surface of the top cover is provided with the concave cavity, and the controlled atmosphere membrane component is disposed in the concave cavity. In the present invention, a space for mounting the controlled atmosphere membrane component is not needed to be configured separately, an opening communicating the controlled atmosphere membrane component and the controlled atmosphere fresh-keeping space is not needed to be formed in a top surface of the storage container, and therefore, the storage container of the refrigerating and freezing device of the present invention has an integrated surface substantially without a slot, thereby ensuring the airtightness of the storage container. In addition, the top cover and the bottom box are sealed by the sealing strip, thereby further improving the airtightness of the controlled atmosphere fresh-keeping space and preventing the nitrogen-rich gas atmosphere of the controlled atmosphere fresh-keeping space from being damaged.

Further, the concave cavity top plate is made of the stainless steel plate. When a humidity in the storage space reaches a critical point at which condensation is generated, after cooling air supply of the refrigerator is started, the stainless steel plate located on the top of the storage container will be quickly cooled. When the air in the controlled atmosphere fresh-keeping space enters the concave cavity, moisture in the air will be condensed on the surface of the concave cavity top plate facing the atmosphere modifying membrane module, and the condensed moisture may be discharged through a water discharge pipeline disposed inside the concave cavity, so that the controlled atmosphere membrane component may remove part of water vapor in the controlled atmosphere fresh-keeping space while removing oxygen gas, thereby avoiding the problem of the condensation in the controlled atmosphere fresh-keeping space.

Further, since the air extracting pump is disposed in the heat preservation layer between the inner container and the housing in the refrigerating and freezing device of the present invention, noise during the operation of the air extracting pump can be significantly reduced, and a better silence experience can be given to a user. Especially, since the air extracting pump is located behind the storage container and the controlled atmosphere membrane component is located at the rear of the accommodating cavity, and a length of a pipeline can be reduced, the loss of a vacuum degree of controlled atmosphere may be reduced.

Further, the refrigerating and freezing device of the present invention not only has a good fresh keeping effect, but also has low requirements on rigidity and strength of the storage container and the like. The implementation requirements are low, so the cost is low. Moreover, the refrigerating and freezing device of the present invention well solves the above technical problem that those skilled in the field of controlled atmosphere fresh keeping have long been eager to solve but have not been able to solve successfully. The refrigerating and freezing device of the present invention is not only small in volume but also low in noise, and is especially suitable for home and personal use.

Further, the refrigerating and freezing device of the present invention is preferably a refrigerator, for example, a household compression type direct cooling refrigerator and a household compression type air cooling refrigerator, and certainly, may also be a semiconductor-refrigeration refrigerator.

According to the detailed description of specific embodiments of the present invention below in conjunction with the accompanying drawings, those skilled in the art will more clearly understand the foregoing and other objectives, advantages, and features of the present invention.

BRIEF DESCRIPTION OF THE DRAWINGS

Hereinafter, some specific embodiments of the present invention will be described in detail in an exemplary and non-limiting manner with reference to the accompanying drawings. The same reference numerals in the drawings indicate the same or similar components or parts. Those skilled in the art will appreciate that these drawings are not necessarily drawn to scale. In the drawings.

DETAILED DESCRIPTION

Figure 1:
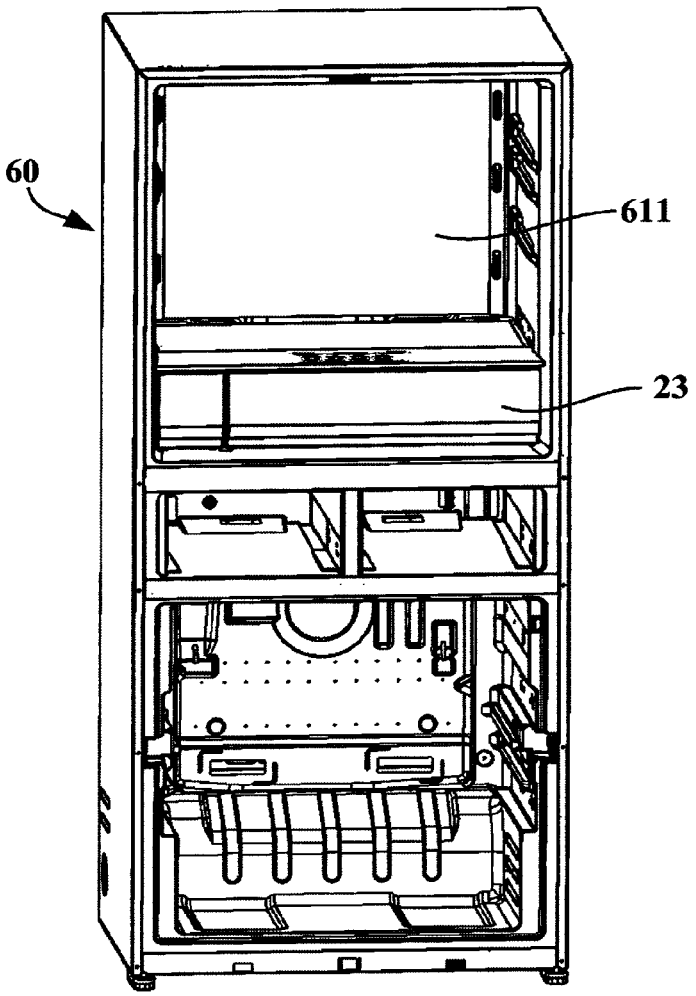
FIG. 1 is a schematic view of a refrigerating and freezing device according to an embodiment of the present invention.
Figure 2:
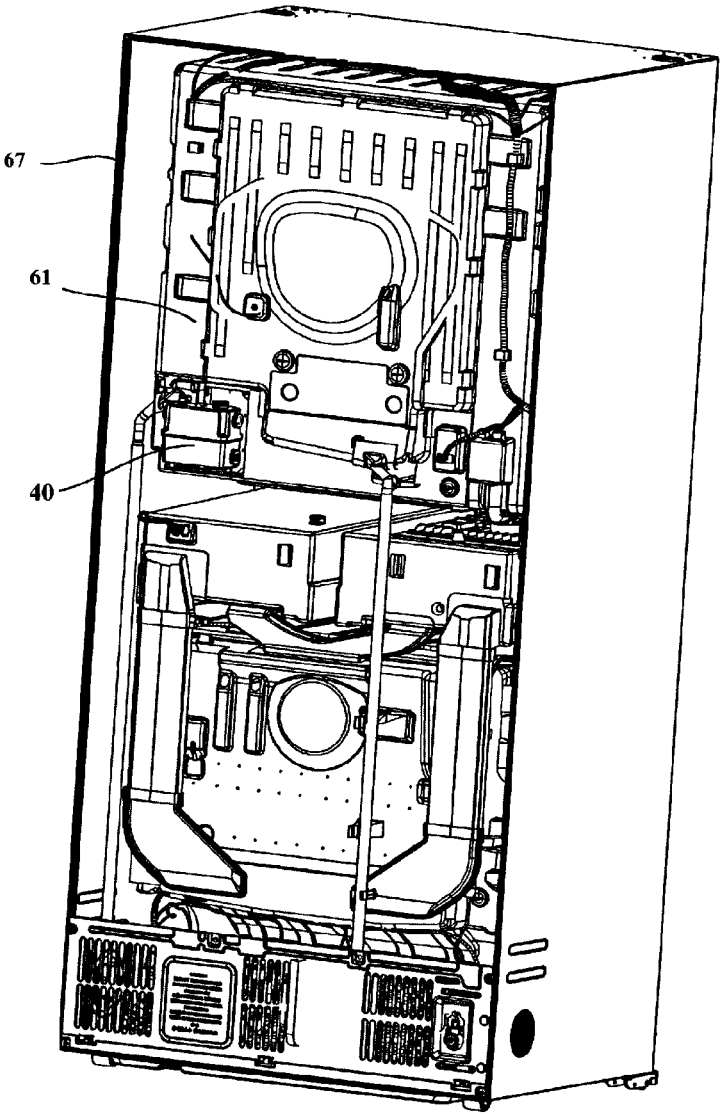
FIG. 2 is a schematic view of a structure shown in FIG. 1 from another viewing angle.
Figure 3:
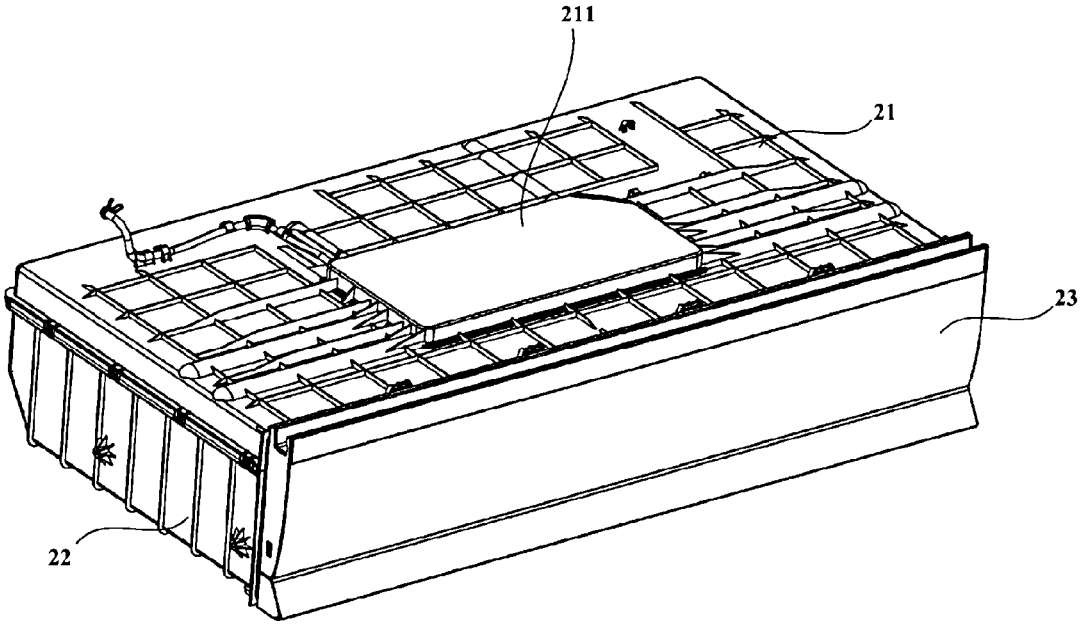
FIG. 3 is a schematic view of a storage container of a refrigerating and freezing device according to an embodiment of the present invention.

Embodiments of the present invention provide a refrigerating and freezing device, as shown in FIG. 1 and FIG. 2, which may include a casing 20, a main door body, a controlled atmosphere membrane component 30, an air extracting device 40, and a refrigeration system.

Figure 4:
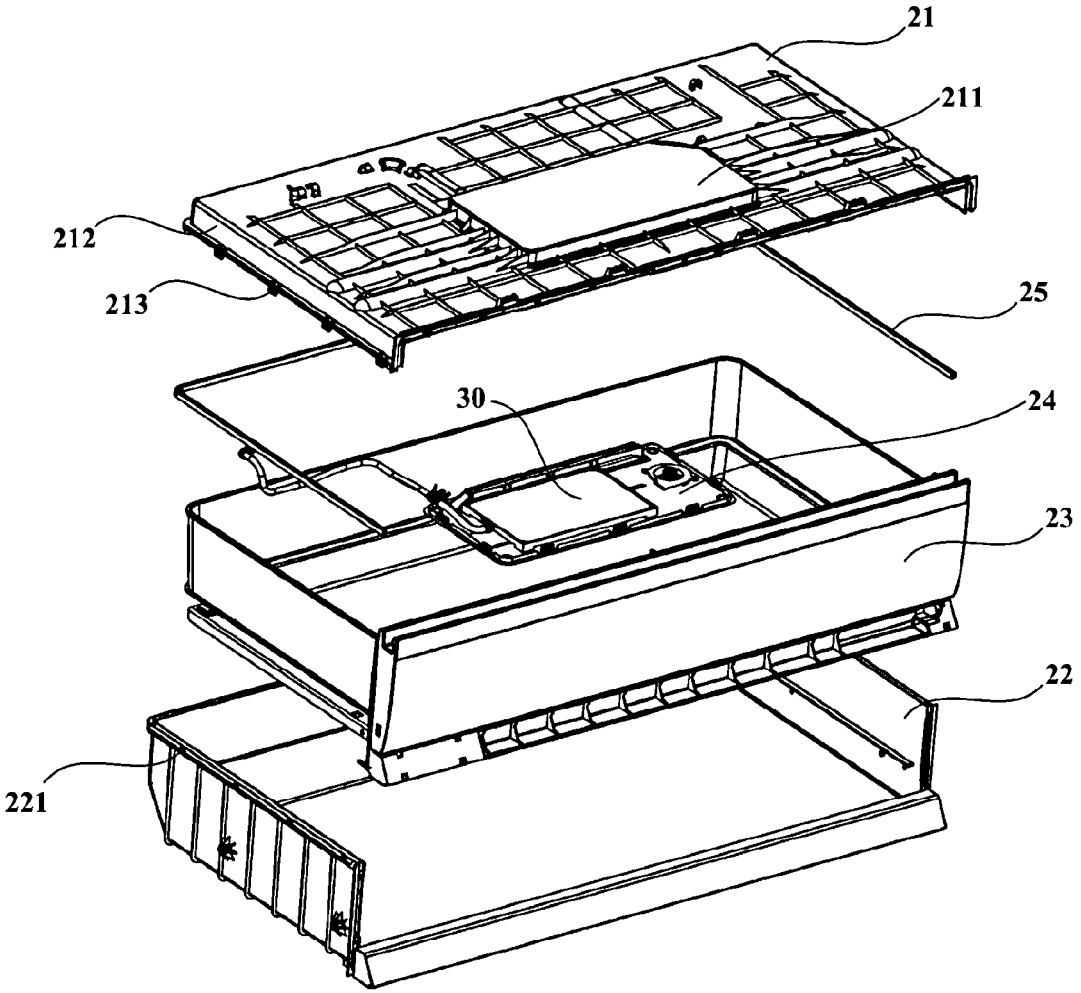
FIG. 4 is a schematic exploded view of a storage container of a refrigerating and freezing device according to an embodiment of the present invention.

The casing 60 may include an inner container 61, a housing 67 disposed on an outer side of the inner container 61, and a heat preservation layer located between the inner container 61 and the housing 67. A storage space 611 is defined in the inner container 61. The main door body may be composed of two side-by-side door bodies, and the two side-by-side door bodies may be both rotatably mounted to the casing 60 and configured to open or close the storage space 611 defined by the casing 60. The main door body may also be one door body. Further, a storage container is disposed in the storage space 611, and the storage container has a controlled atmosphere fresh-keeping space therein. The controlled atmosphere fresh-keeping space may be a sealed space or an approximately sealed space. Preferably, the storage container is a storage drawer, which may be disposed at a lower portion of the storage space 611. As shown in FIG. 4, the storage drawer includes a drawer cylinder and a drawing portion 23. The drawer cylinder further includes a top cover 21 and a bottom box 22, and the bottom box 22 may have a forward opening. The drawing portion 23 is slidably disposed in the drawer cylinder 22 so as to be operatively drawn out of the forward opening of the bottom box 22 outward and inwards inserted into the drawer cylinder 22. The drawing portion 23 may include a drawer end cover, and the drawer end cover may be matched with the opening of the bottom box 22 to seal the controlled atmosphere fresh-keeping space. In some alternative embodiments, the storage container may be a storage box, that is, it includes only the top cover 21 and the bottom box 22.

Figure 5:
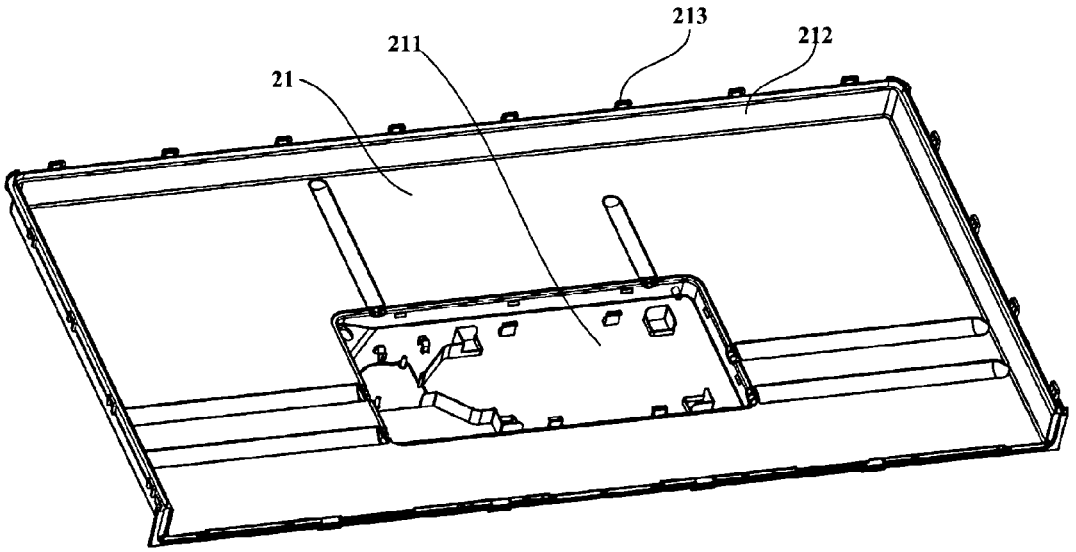
FIG. 5 is a schematic view of a top cover of a storage container of a refrigerating and freezing device according to an embodiment of the present invention.

In the present embodiment, as shown in FIG. 5, a peripheral edge of the top cover 21 is provided with a flange 212 to facilitate connection to the bottom box 22, and a plurality of buckles 213 are disposed at a bottom end edge of the flange 212. An edge of the bottom box 22 facing the top cover 21 is correspondingly provided with a plurality of protrusions 221, and the protrusions 221 are inserted into the buckles 213 to achieve snap fit assembling of the top cover 21 and the bottom box 22. Preferably, a U-shaped sealing strip 25 is additionally disposed between joint edges of the top cover 21 and the bottom box 22 to seal a gap between the top cover 21 and the bottom box 22, thereby ensuring the airtightness of the storage container. In the present embodiment, the U-shaped sealing strip 25 is made of a silicone material. A cross section of the U-shaped sealing strip 25 is concave, an upper edge of the bottom box 22 is provided with a groove for accommodating the U-shaped sealing strip 25, the U-shaped sealing strip 25 is embedded into the groove along the upper edge of the bottom box 22, and an opening of the concave structure of the U-shaped sealing strip 25 is disposed upward. When the top cover 21 is assembled onto the bottom box 22 by snap fit, a lower edge of the flange 212 of the top cover 21 is inserted into the groove of the U-shaped sealing strip 25 to achieve a sealed connection between the top cover 21 and the bottom box 22. In some alternative embodiments, the storage container may be a storage box, and the sealing strip 25 may be a rectangular loop.

Figure 6:
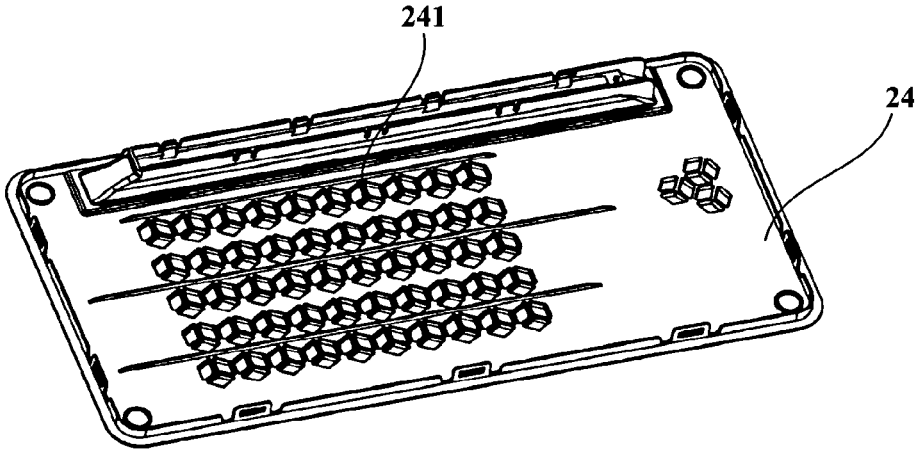
FIG. 6 is a schematic view of a concave cavity bottom plate of a storage container of a refrigerating and freezing device according to an embodiment of the present invention.
Figure 7:
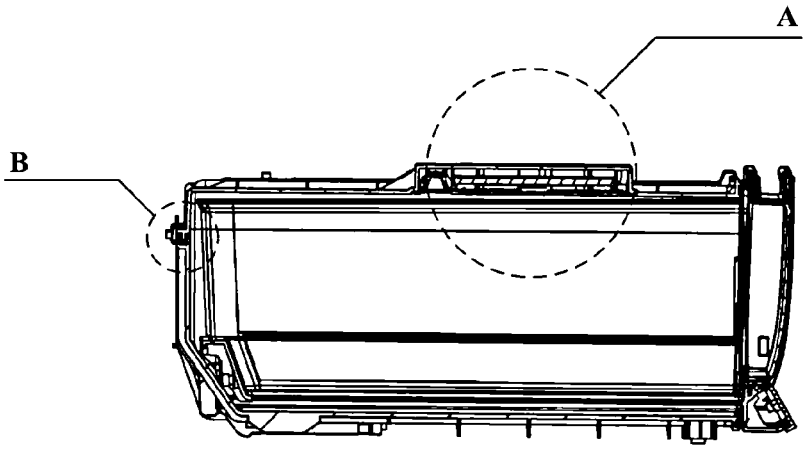
FIG. 7 is a side sectional view of a storage container of a refrigerating and freezing device according to an embodiment of the present invention.
Figure 8:
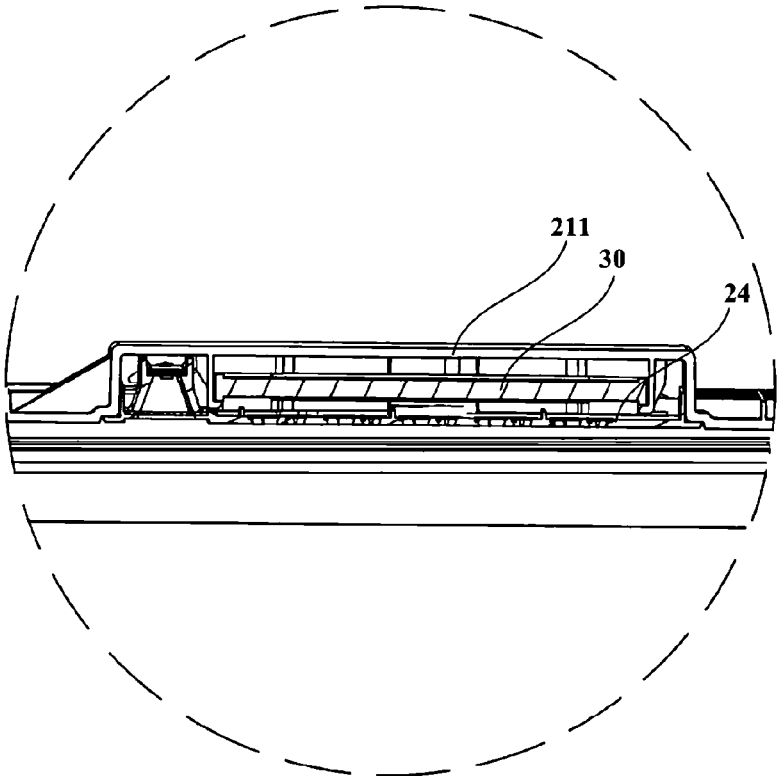
FIG. 8 is a partial enlarged schematic view of an area A shown in FIG. 7.
Figure 9:
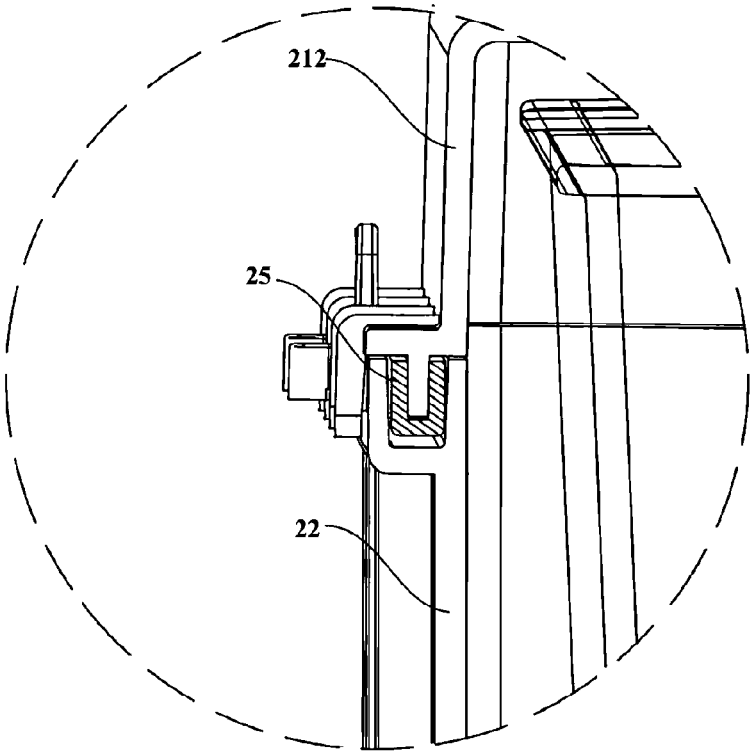
FIG. 9 is a partial enlarged schematic view of an area B shown in FIG. 7.

As shown in FIG. 5, a lower surface of the top cover 21 is provided with a concave cavity. The concave cavity is a rectangular concave cavity, and is disposed at the center of the top cover 21 to accommodate the controlled atmosphere membrane component 30. A thickness of the concave cavity is slightly greater than a thickness of the controlled atmosphere membrane component such that the controlled atmosphere membrane component 30 is spaced apart a certain distance from an upper surface and a lower surface of the concave cavity, so that the air of the controlled atmosphere fresh-keeping space may enter the inside of the concave cavity. As shown in FIG. 6, the storage container further includes a concave cavity bottom plate 24. The concave cavity bottom plate 24 is detachably disposed at an opening of the concave cavity and configured to partially close the concave cavity and support the controlled atmosphere membrane component. In the present embodiment, the concave cavity bottom plate 24 is assembled to the opening of the concave cavity by snap fit. The concave cavity bottom plate 24 and the concave cavity of the top cover 21 together form a space for accommodating the controlled atmosphere membrane component 30. The concave cavity bottom plate 24 is provided with a plurality of air holes 241 such that an inner space of the concave cavity communicates with the controlled atmosphere fresh-keeping space.

Figure 10:
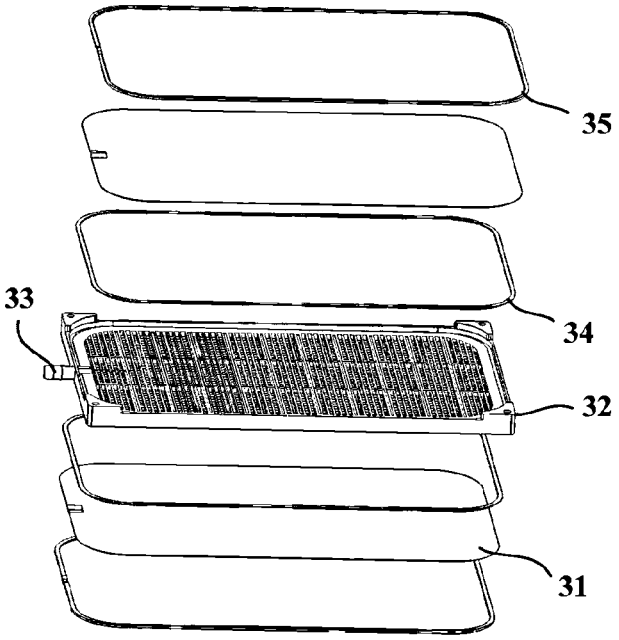
FIG. 10 is an exploded view of a controlled atmosphere membrane component in a refrigerating and freezing device according to an embodiment of the present invention.

As shown in FIG. 10, the controlled atmosphere membrane component 30 is in a shape of a flat plate, is disposed inside the rectangular concave cavity, and includes at least one controlled atmosphere membrane 31 and an oxygen gas-enriched collecting cavity, and a space around the controlled atmosphere membrane component communicates with the controlled atmosphere fresh-keeping space. The controlled atmosphere membrane component 30 may be configured to allow more oxygen gas in an airflow in the space around the controlled atmosphere membrane component 30 than nitrogen gas in the airflow in the space around the controlled atmosphere membrane component 30 to pass through the controlled atmosphere membrane 31 to enter the oxygen gas-enriched collecting cavity. Specifically, an inner side surface of each controlled atmosphere membrane 31 faces the oxygen gas-enriched collecting cavity, so that when a pressure of the oxygen gas-enriched collecting cavity is less than a pressure in the space around the controlled atmosphere membrane component 30, more oxygen gas than nitrogen gas in air of an outer space of the controlled atmosphere membrane component 30 passes through the at least one controlled atmosphere membrane 31 to enter the oxygen gas-enriched collecting cavity.

In some embodiments of the present invention, the controlled atmosphere membrane component 30 may further include a support framework 32. The controlled atmosphere membrane 31 is preferably an oxygen enrichment membrane, and the controlled atmosphere membranes may be two installed on two sides of the support framework 32 such that the two controlled atmosphere membranes 31 and the support framework 32 together form the oxygen gas-enriched collecting cavity. Further, the support framework 32 may include a side frame, and structures such as ribbed plates and/or flat plates disposed in the side frame. Airflow passages may be formed between the ribbed plates, between the ribbed plate and the flat plate, etc., and grooves may be formed in the surface of the ribbed plates and the surface of the flat plates to form the airflow passages. The ribbed plates and/or the flat plates may improve the structural strength and the like of the controlled atmosphere membrane component 30. That is, the support framework 32 has a first surface and a second surface parallel to each other, the plurality of airflow passages respectively extending on the first surface, extending on the second surface, and penetrating through the support framework 32 to communicate the first surface and the second surface are formed in the support framework 32, and the plurality of airflow passages together form the oxygen gas-enriched collecting cavity. The controlled atmosphere membrane 31 is two planar controlled atmosphere membranes respectively laid on the first surface and the second surface of the support framework 32.

In some embodiments of the present invention, the support framework 32 includes an air extracting hole 33 communicating with the at least one airflow passage, which air extracting hole 33 is disposed on the side frame to allow oxygen gas in the oxygen gas-enriched collecting cavity to be output. The air extracting hole 33 communicates with the air extracting pump 41. The air extracting hole 33 may be disposed on a long edge of the side frame or disposed on a short edge of the side frame, so as to be determined according to a disposition position or actual design requirements of the controlled atmosphere membrane component 30. For example, in the embodiments shown in FIG. 4 and FIG. 10, the air extracting hole 33 may be disposed on the long edge of the side frame. The controlled atmosphere membrane 31 is firstly mounted to the side frame by a double-sided adhesive tape 34 and then sealed by a sealant 35.

In some embodiments, the support framework 32 may include a side frame, a plurality of first ribbed plates, and a plurality of second ribbed plates. The plurality of first ribbed plates are disposed inside the side frame at intervals along a longitudinal direction and extend in a lateral direction, and a side surface of the plurality of first ribbed plates forms the first surface. The plurality of second ribbed plates are disposed on another side surface of the plurality of first ribbed plates at intervals along a lateral direction and extend along a longitudinal direction, and a side surface of the plurality of second ribbed plates away from the first ribbed plates forms the second surface. According to the support framework 32 of the present invention, the plurality of first ribbed plates that are disposed at intervals along the longitudinal direction and extend along the lateral direction, and the plurality of second ribbed plates that are disposed on one side surface of the plurality of first ribbed plates at intervals along the lateral direction and extend along the longitudinal direction are disposed inside the side frame, thereby ensuring the continuity of the airflow passages on the one hand, and greatly reducing the volume of the support framework 32 and greatly improving the strength of the support framework 32 on the other hand. In addition, the structure of the support framework 32 ensures that the controlled atmosphere membrane 31 may obtain sufficient support, and may be always kept at a good flatness even when the negative pressure inside the oxygen gas-enriched collecting cavity is high, thereby ensuring the service life of the controlled atmosphere membrane component 30.

In a further embodiment, the above-mentioned plurality of first ribbed plates may include: a plurality of first narrow ribbed plates and a plurality of first wide ribbed plates. The plurality of first wide ribbed plates are disposed at intervals, and the plurality of first narrow ribbed plates are disposed between the adjacent two first wide ribbed plates. The above-mentioned plurality of second ribbed plates may include: a plurality of second narrow ribbed plates and a plurality of second wide ribbed plates. The plurality of second wide ribbed plates are disposed at intervals, and the plurality of second narrow ribbed plates are disposed between the adjacent two second wide ribbed plates. Those skilled in the art will readily understand that "wide" and "narrow" herein are relative terms.

In some embodiments, each first wide ribbed plate is depressed inward from a side surface that forms the first surface to form a first trench, and each second wide ribbed plate is depressed inward from a side surface that forms the second surface to form a second trench, thereby improving the connectivity of an inside grid structure on the premise of ensuring that the thickness (or volume) of the support framework 32 is very small.

In some exemplary embodiments, the top cover 21 further includes a concave cavity top plate 211 forming a top surface of the concave cavity, and the concave cavity top plate 211 is made of a stainless steel plate. When too much water vapor exists inside the storage container, condensation will be generated, and food will rot easily in a humid environment. When the humidity in the storage space reaches a critical point at which the condensation is generated (the relative humidity is 95% or more), after cooling air supply of the refrigerator is started, the stainless steel plate located on the top of the storage container will be quickly cooled (its temperature is much lower than that of other positions of the top cover). When the air in the controlled atmosphere fresh-keeping space enters the concave cavity, moisture in the air will be condensed on the surface of the concave cavity top plate 211 facing the controlled atmosphere membrane component 30, and the condensed moisture may be discharged through a water discharge pipeline disposed inside the concave cavity, thereby solving the problem of the condensation caused by storage of high-moisture fruit and vegetable articles inside the controlled atmosphere space. The concave cavity top plate 211 and the top cover 21 are integrally formed to ensure the airtightness of the storage container.

The air extracting device 40 may include an air extracting pump 41, and is configured to extract gas penetrating into the oxygen gas-enriched collecting cavity to an outside of the storage container.

In the present embodiment, the air extracting device 40 may be used to extract air outward, so that a pressure of the oxygen gas-enriched collecting cavity may be less than a pressure in the space around the controlled atmosphere membrane component 30, and further, oxygen gas in the space around the controlled atmosphere membrane component 30 may enter the oxygen gas-enriched collecting cavity. Since the controlled atmosphere fresh-keeping space communicates with the concave cavity space provided with the controlled atmosphere membrane component 30, the air in the controlled atmosphere fresh-keeping space will enter the space around the controlled atmosphere membrane component 30, and therefore, oxygen gas in the air in the controlled atmosphere fresh-keeping space may also be allowed to enter the oxygen gas-enriched collecting cavity, thereby obtaining a nitrogen-rich oxygen-depleted gas atmosphere that is beneficial to food fresh keeping in the controlled atmosphere fresh-keeping space.

By using the refrigerating and freezing device of the present invention, the nitrogen-rich oxygen-depleted gas atmosphere that is beneficial to food fresh keeping may be formed in the controlled atmosphere fresh-keeping space. The gas atmosphere reduces the aerobic respiration intensity of fruits and vegetables by reducing the oxygen gas content in the fruit and vegetable storage space, and at the same time, ensures the basic respiration and prevents the fruits and vegetables from anaerobic respiration, thereby achieving the objective of long-term fresh keeping of fruits and vegetables. Moreover, the gas atmosphere also has gas such as abundant nitrogen gas, and will not reduce the cooling efficiency of the articles in the controlled atmosphere fresh-keeping space, so that the fruits and vegetables and the like may be effectively stored. Moreover, the refrigerating and freezing device of the present invention has low requirements on rigidity and strength of the storage container and the like, and the implementation requirements are low, so the cost is low. The refrigerating and freezing device of the present invention well solves the above technical problem that those skilled in the field of controlled atmosphere fresh keeping have long been eager to solve but have not been able to solve successfully. The refrigerating and freezing device of the present invention is not only small in volume but also low in noise, and is especially suitable for home and personal use.

Figure 11:
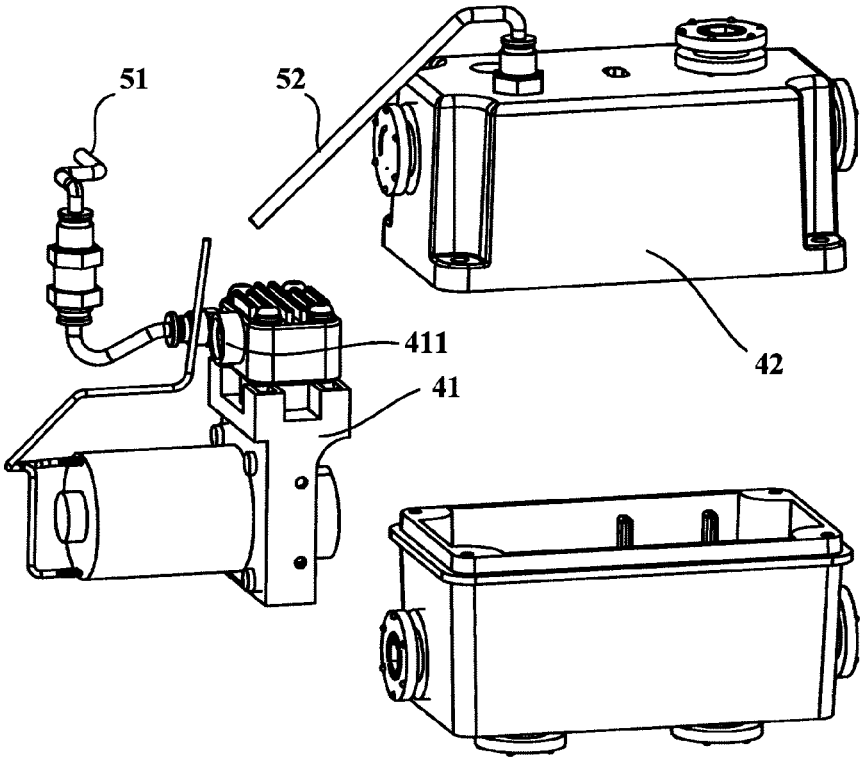
FIG. 11 is a schematic exploded view of an air extracting device in a refrigerating and freezing device according to an embodiment of the present invention.

As shown in FIG. 11, the air extracting device 40 may further include a seal box 42, and the air extracting pump 41 may be disposed in the seal box 42. An air extracting opening of the air extracting pump 41 communicates to a vent port of the oxygen gas-enriched collecting cavity via an air extracting pipeline 51. A vent port 411 of the air extracting pump 41 communicates with an inner space of the seal box 42. Specifically, the vent port 411 of the air extracting pump 41 may not be connected to a pipeline and may be exposed to the inside of the seal box 42. A gas discharge pipeline 52 communicating with the inner space of the seal box 42 is disposed on the seal box 42. In some alternative embodiments of the present invention, the air extracting pipeline 51 may be wound around a pump casing of the air extracting pump 41. In other alternative embodiments of the present invention, the vent port of the air extracting pump 41 may be provided with a vent pipe in which air is blown to its own pump casing.

In some embodiments of the present invention, the air extracting device 40 is preferably disposed in the heat preservation layer between the inner container 61 and the housing 67. The air extracting pump 41 is disposed in the heat preservation layer, so noise during the operation of the air extracting pump 41 may be significantly reduced, and a better silence experience may be given to the user. Further, the housing 67 may include a back plate, and the air extracting device 40 is disposed between a back wall of the inner container 61 and the back plate of the housing 67 and located behind the storage container, so that a length of the air extracting pipeline 51 between the air extracting pump 41 and the controlled atmosphere membrane component 30 may be reduced, and the loss of vacuum degree of controlled atmosphere may be reduced.

The seal box 42 may also reduce noise generated during the operation of the air extracting pump 41. In order to further reduce noise, a plurality of damping pads may be disposed between the air extracting pump 41 and the seal box 42. An outer side of the seal box 42 may also be provided with a plurality of damping blocks such that the seal box is mounted in the heat preservation layer.

Thus, those skilled in the art should appreciate that, although a number of exemplary embodiments of the present invention have been shown and described in detail herein, many other variations or modifications consistent with the principles of the present invention can still be directly determined or deduced according to the disclosure of the present invention without departing from the spirit and scope of the present invention. Therefore, the scope of the present invention should be understood and recognized as covering all these other variations or modifications.

The invention claimed is:

1. A refrigerating and freezing device, comprising:

a casing, wherein a storage space is defined in the casing, a storage container is disposed in the storage space, and the storage container comprises a controlled atmosphere fresh-keeping space therein, the storage container comprising:

a top cover, wherein a lower surface of the top cover is provided with a concave cavity; and a bottom box, disposed below the top cover, and forming the controlled atmosphere fresh-keeping space together with the top cover; and a controlled atmosphere membrane component, disposed inside the concave cavity, wherein the controlled atmosphere membrane component comprises at least one controlled atmosphere membrane and an oxygen gas-enriched collecting cavity, a space inside the concave cavity and around the controlled atmosphere membrane component communicates with the controlled atmosphere fresh-keeping space, and the controlled atmosphere membrane component is configured to allow more oxygen gas in an airflow in the space around the controlled atmosphere membrane component than nitrogen gas in the airflow in the space around the controlled atmosphere membrane component to pass through the controlled atmosphere membrane to enter the oxygen gas-enriched collecting cavity.

2. The refrigerating and freezing device according to claim 1, wherein the top cover comprises a concave cavity top plate forming a top surface of the concave cavity, and the concave cavity top plate is made of a stainless steel plate.

3. The refrigerating and freezing device according to claim 1, wherein an edge of the top cover is provided with a plurality of buckles, an edge of the bottom box facing the top cover is correspondingly provided with a plurality of protrusions, and each of the protrusions is inserted into the corresponding buckle to achieve snap fit assembling of the top cover and the bottom box.

4. The refrigerating and freezing device according to claim 1, wherein the storage container is a storage drawer, and a front side surface of the bottom box is provided with a drawer opening, and the storage drawer further comprising:

a drawing portion, capable of being pushed into an inside of the bottom box or drawn out of the inside of the bottom box to open or close the controlled atmosphere fresh-keeping space.

5. The refrigerating and freezing device according to claim 1, wherein the storage container further comprises:

a sealing strip, disposed between joint edges of the top cover and the bottom box to seal a gap between the top cover and the bottom box.

6. The refrigerating and freezing device according to claim 1, wherein the controlled atmosphere membrane component further comprises a support framework having a first surface and a second surface parallel to each other, a plurality of airflow passages respectively extending on the first surface, extending on the second surface, and penetrating through the support framework to communicate the first surface and the second surface are formed in the support framework, and the plurality of airflow passages together form the oxygen gas-enriched collecting cavity; and the at least one controlled atmosphere membrane is two planar controlled atmosphere membranes respectively laid on the first surface and the second surface of the support framework.

7. The refrigerating and freezing device according to claim 1, wherein the storage container further comprises:

a concave cavity bottom plate, detachably disposed at an opening of the concave cavity, and configured to partially close the concave cavity and support the controlled atmosphere membrane component.

8. The refrigerating and freezing device according to claim 7, wherein the concave cavity bottom plate is provided with a plurality of air holes such that the controlled atmosphere membrane component communicates with the controlled atmosphere fresh-keeping space.

9. The refrigerating and freezing device according to claim 1, further comprising:

an air extracting device, wherein the air extracting device comprises an air extracting pump, and is configured to extract gas penetrating into the oxygen gas-enriched collecting cavity to an outside of the storage container, and enable gas flowing out of the oxygen gas-enriched collecting cavity to firstly perform heat exchange with a pump casing of the air extracting pump and then enter the air extracting pump, or enable the gas flowing out of the oxygen gas-enriched collecting cavity to firstly enter the air extracting pump and flow out of the air extracting pump and then perform heat exchange with the pump casing of the air extracting pump.

10. The refrigerating and freezing device according to claim 9, wherein the air extracting device further comprises a seal box to accommodate the air extracting pump; and an air extracting opening of the air extracting pump communicates to a vent port of the oxygen gas-enriched collecting cavity via an air extracting pipeline, and a vent port of the air extracting pump communicates with an inner space of the seal box; and a gas discharge pipeline communicating with the inner space of the seal box is disposed on the seal box.

11. The refrigerating and freezing device according to claim 10, wherein the casing comprises an inner container, a housing disposed on an outer side of the inner container, and a heat preservation layer located between the inner container and the housing; a storage space is defined in the inner container; and the air extracting device is disposed in the heat preservation layer between the inner container and the housing.

* * * * *